US006427932B1

(12) United States Patent
Danckert et al.

(10) Patent No.: US 6,427,932 B1
(45) Date of Patent: Aug. 6, 2002

(54) FUEL INJECTION NOZZLE FOR AN INTERNAL COMBUSTION ENGINE

(75) Inventors: Bernd Danckert, Meckenbeuren; Bernhard Schuetz, Braeunlingen, both of (DE)

(73) Assignee: MTU Motoren-und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/674,928

(22) PCT Filed: May 7, 1999

(86) PCT No.: PCT/EP99/03160

§ 371 (c)(1),
(2), (4) Date: Feb. 12, 2001

(87) PCT Pub. No.: WO99/58844

PCT Pub. Date: Nov. 18, 1999

(30) Foreign Application Priority Data

May 8, 1998 (DE) ..... 198 20 513

(51) Int. Cl.[7] ..... B05B 1/14
(52) U.S. Cl. ..... 239/533.12; 123/467
(58) Field of Search ..... 239/533.12, 533.1, 239/533.2, 533.3, 533.7, 596; 123/467

(56) References Cited

U.S. PATENT DOCUMENTS 4,273,291 A * 6/1981 Miller ..... 239/533.12
4,417,694 A * 11/1983 Claxton et al. ..... 239/533.3
4,934,605 A * 6/1990 Hans et al. ..... 239/585
5,743,470 A * 4/1998 Schlaf el al. ..... 239/533.4
6,062,498 A * 5/2000 Klopfer ..... 239/533.2
6,186,419 B1 * 2/2001 Kampmann et al. ..... 239/533.3

FOREIGN PATENT DOCUMENTS

| | | |
|---|---|---|
| DE | 05 082 | 8/1987 |
| DE | 38 10 467 | 10/1989 |
| DE | 195 47 423 | 6/1997 |
| DE | 196 34 933 | 3/1998 |

* cited by examiner

*Primary Examiner*—Willis R. Wolfe
*Assistant Examiner*—Mahmoud Gimie
(74) *Attorney, Agent, or Firm*—Crowell & Moring LLP

(57) ABSTRACT

The invention relates to a fuel injection nozzle for an internal combustion engine, especially of a common-rail injection system. The injection nozzle contains a nozzle needle which is coupled to an actuating element that serves to control a nozzle opening process. The nozzle needle comprises a needle point and a valve seat which interacts with the same. The valve seat has a conical sealing surface with an opening angle $\alpha_1$, and the needle point has a conical sealing surface with an opening angle $\alpha_2$. The opening angle $\alpha_2$ of the sealing surface of the needle point is smaller than the opening angle $\alpha_1$ sealing surface of valve seat. An expansion, said expansion serving as a cavitation chamber, of a ring-shaped flow channel, is configured between the needle point and the needle housing in the direction of flow of the fuel following the sealing surfaces of the needle point and valve seat. The cavitation chamber is configured and dimensioned to achieve a targeted cavitation results.

31 Claims, 3 Drawing Sheets

FUEL INJECTION NOZZLE FOR AN INTERNAL COMBUSTION ENGINE

The invention relates to a fuel injector for a combustion engine, in particular in a common rail injection system in which the injector is continuously stressed by fuel held in a preliminary reservoir under high pressure, whereby the fuel injector contains a nozzle needle linked with an actuating element that serves to control a nozzle-opening process with a needle tip and a valve seat that works together with the needle tip of the nozzle needle, whereby the valve seat has a conical sealing surface with the opening angle $a_1$ and the needle tip, when the injector is closed, has a conical sealing surface contacting it with an opening angle $a_2$ and needle tip and needle housing delimit a ring-shaped flow channel.

In fuel injectors of this type, there is the difficulty that often even after a short period of service a great deal of damage can be found because of cavitation below the valve seat on nozzle needle tip and needle housing which can lead to a lack of seal integrity in the valve seat and to failure of the injector. This type of cavitation damage can occur in particular in common rail injector systems since because of the continuous presence of high pressure from the fuel under high pressure in the preliminary reservoir, considerably longer cavitation phases can occur during opening and closing of the injector compared to injectors of standard fuel injection systems.

A fuel injector for combustion engines is known from DE 36 05 082 A1 which is intended for a standard injection system and in which the needle tip sealing surface that works together with the valve seat is provided with a ring groove which serves to create a turbulent interface in the flows. Downstream of the sealing surface, a convex-shaped shroud surface section is provided on the needle tip which is followed by a concave-shaped shroud surface section. Because of this, the tendency of the flow to break down in the area of the valve passage will be decreased and the flow and/or the spray pattern will be improved.

DE 196 34 933 A1 shows a fuel injector in which two areas having different cone angles have a valve sealing surface in the transition, downstream of the valve seat, have a groove-shaped expansion. The expansion serves to increase the metering accuracy of the injection quantity, in that a defined position is created with respect to the sealing edge. DE 195 47 423 A1 also uses groove-shaped expansions below the valve seat in the nozzle body or nozzle needle in order to produce a defined line of contact. The radial recess that represents an expansion is very flat and specified at 0.01 to 0.06 mm. It should be assumed that this expansion increases the cavitation still further and the nozzle needle and the nozzle body are subject to damage by erosion in the adjacent walls which ultimately leads to injector damage.

The task of the invention is to produce a fuel injector which has low susceptibility to cavitation damage on nozzle needle and needle housing in the area of the valve seat.

This task is solved by the fuel injector indicated in claim 1. Advantageous further developments of the injector according to the invention are identified in the subclaims.

The invention produces a fuel injector for a combustion engine, in particular of a common rail injection system, in which the injector is continuously stressed by fuel held under high pressure in a preliminary reservoir. The fuel injector contains a nozzle needle linked with an actuating element that serves to control a nozzle-opening process with a needle tip and a valve seat that works together with the needle tip of the nozzle needle, whereby the valve seat has a conical sealing surface with the opening angle $a_1$ and the needle tip, when the injector is closed, has a conical sealing surface contacting it with an opening angle $a_2$ and needle tip and needle housing delimit a ring-shaped flow channel. It is provided that the opening angle $a_2$ of the needle tip sealing surface is smaller than the opening angle $a_1$ of the sealing surface of the valve seat and that in the flow direction of the fuel, following the sealing surfaces, an expansion of the ring-shaped flow channel is formed between needle tip and needle housing in such a way that the expansion is designed as a cavitation space, in which the implosion of the cavitation bubbles will occur away from the wall. This means that size and shape of the cavitation space is maintained with the goal that the cavitation bubbles are guided at a distance from the walls of the ring-shaped flow channel formed by the nozzle needle and needle housing and thereby no erosion on the walls occurs.

Because of the inverse seat angle difference, the narrowest part of the needle sealing seat is located at the downstream end where cavitation forms as defined, its cavitation bubbles then do not have any opportunity in the following expansion to deposit themselves on the walls of needle tip and/or needle housing and thus cannot cause any damage. Since cavitation on the nozzle needle is more critical than on the needle housing, it can be adequate to make the expansion preferably in such a way that cavitation bubbles disintegrate at least far from the walls of the nozzle needle. In fact, erosion on the nozzle needle influences the function of the injector by changing the opening behavior.

According to an especially preferred embodiment, it is provided that the expansion of the flow channel is provided between needle tip and needle housing directly on the sealing surfaces of needle tip and valve seat.

Preferably the expansion of the flow channel between needle tip and needle housing is formed by a curve that is concave in cross section of at least one of the surfaces of needle tip and needle housing.

An especially advantageous embodiment of this provides that the concave curve of the surface of the needle tip and/or needle housing is formed by a radius.

According to a preferred embodiment, it is provided that the concave curve of the surface at the upstream side gradually changes, with one edge, into the sealing surface of needle tip and/or valve seat.

In addition, it can be provided that the concave curve of the surface at the downstream side gradually changes, with one edge, into the surface of needle tip and/or needle housing.

According to an especially preferred embodiment of the fuel injector according to the invention, it is provided that both on the surface of the needle tip and needle housing an expansion of the flow channel with concave curve is provided and that the center of the expansion of the needle housing is displaced toward the upstream direction compared to the center of the needle tip expansion when the valve is closed.

According to a preferred embodiment, it is provided that the expansions on needle housing and needle tip are formed by equal radii.

The opening angle $a_1$ of the valve seat is preferably between 50° and 60°, preferably between 55° and 65°.

According to an especially preferred embodiment, the opening angle of the valve seat is around 60°.

The opening angle $a_2$ of the needle tip sealing surface is advantageously between 0.5° to 3°, preferably 1° and 2°, smaller than the opening angle $a_1$ of the valve seat.

It is especially advantageous to make the opening angle $a_2$ of the needle tip sealing surface 1.5° smaller than the opening angle $a_1$ of the valve seat.

According to an advantageous further development of the invention, it is provided that on the needle tip, upstream of the sealing surface, a transition surface is formed that has an angle $a_3$ between that of the needle body and that of the sealing surface of the nozzle needle. This transition surface improves the flow behavior at the transition from needle body to sealing surface.

This transition surface is preferably formed by a conical surface.

Preferably the transition surface is designed in such a way that it approximately halves the angle between the sealing surface of the nozzle needle and the needle body.

According to a preferred further development of the fuel injector according to the invention, it is provided that the needle tip has an end section that comes to a point. This has the advantage that the nozzle needle extends with its end section far into a hole formed on the downstream end of the needle housing which decreases the pocket hole volume.

Preferably the end section that comes to a point is formed as a cone.

According to a preferred embodiment, it is planned that the cone forming the end section that comes to a point has an opening angle $a_4$ that is smaller than the opening angle $a_2$ of the needle tip sealing surface.

The opening angle $a_4$ of the end section is advantageously between 40° and 65°, preferably between 50° and 55°.

According to a further development of the invention, it is provided that the needle tip, upstream of the sealing surface, has a beadshaped section that is enlarged compared to the diameter of the needle body.

This bead-shaped section can be formed of successive conical and/or cylindrical ring surfaces.

Alternatively, the bead-shaped section can be formed of a lens-shaped or ball-shaped surface.

Preferably the diameter of the bead-shaped section is 1.05 times to 1.2 times, preferably 1.1 times to 1.15 times, the diameter of the needle body of the nozzle needle.

The longitudinal expansion of the bead-shaped section in the direction of the needle axis is advantageously 0.2 times to 0.6 times, preferably 0.25 times to 0.35, times the diameter of the needle body of the nozzle needle.

In the following, preferred embodiments of the invention will be explained using the drawing.

Figure 1:
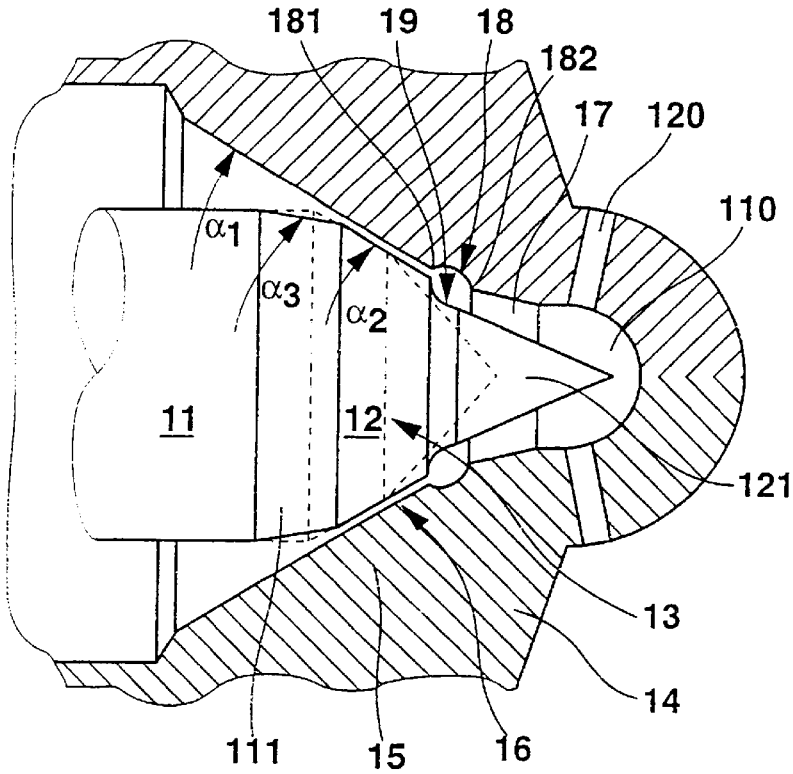
FIG. 1 shows a cut-away side view of a fuel injector in the area of the needle tip according to a first embodiment of the invention.

FIG. 1 shows the cut-away side view of an injector of a common rail injection system in the area of the needle tip of the nozzle needle. In a needle housing 14, a nozzle needle whose needle body is provided with reference number 11, is mounted so that it can slide axially. On the needle tip 12, there is a conical sealing surface 13, which works together with the sealing surface 16 of a valve seat 15 provided on the needle housing 14 in the sense of opening and closing the injector by movement of the nozzle needle 11. On the end opposite the needle tip 12, the nozzle needle 11 is linked to an actuating element that serves to control the nozzle opening which is not shown in the figure.

On the front side of nozzle needle 11, in needle housing 14 a pocket hole 110 is formed from which the injector openings 120 extend, which are used to inject the fuel into the combustion chamber of the combustion engine. The needle tip 12 of nozzle needle 11 is provided with an end section 121 in the form of a cone that comes together in a point which extends deeply into the pocket hole 110. Between the sealing surface 13 and conical end section 121, on the surface of needle tip 12, an expansion of the flow channel 17 that is formed as a ring shape between needle tip 12 and needle housing 14 in the form of a concave curve 19 in cross section. Opposite this concave curve 19 of needle tip 12, an expansion is produced on the inner wall of needle housing 14 of the flow channel 17 that is formed as a ring shape between needle tip 12 and needle housing 14 in the shape of a concave curve 18. A transition surface 111 is formed between the sealing surface 13 and the needle body 11 which has an angle $a_3$ and essentially halves the angle between the cylindrical surface area of needle body 11 and sealing surface 13. The sealing surface 16 of valve seat 15 has an opening angle $a_1$ which in the embodiment shown is 60° while the sealing surface 13 of needle tip 12 has an opening angle $a_2$ which is smaller than opening angle $a_1$ of sealing surface 16 of valve seat 15, which in the embodiment shown is 58.5°. Thus, the narrowest point of the needle sealing seat is located between sealing surface 13 of nozzle needle tip 12 and sealing surface 16 of valve seat 15 in the front area of needle tip 12, which means an inverse seat angle difference in comparison to standard sealing seat geometries. After this narrow point, the ring-shaped flow channel 17 that is formed between needle tip 12 and needle housing 14 is expanded by concave curves 18, 19 whereby a "cavitation trap" or cavitation space is formed for the cavitation bubbles that are formed in a defined way because of the inverse seat angle difference at the narrowest point of the needle sealing seat directly upstream of the concave 18, 19. For comparison with a standard needle tip geometry, one is shown in dotted lines in FIG. 1. The recess on nozzle needle and needle housing represents a sudden expansion in which cavitation bubbles form selectively. In this process, the recess is designed or dimensioned in such a way that the subsequent implosion of the cavitation bubbles does not occur in the immediate area of the walls, rather much more so in the center of the flow or at least at a distance from the nozzle needle. The slot width formed by the expansion is more than 0.05 mm at the widest point. Slot widths of 0.5 mm or more are more favorable. In the downstream connection to the cavitation space, a flow channel follows whose cross section is preferably designed in such a way that the flow speed is kept approximately constant. Preferably the cone-shaped wall of the needle housing after the cavitation space is sloped somewhat steeper than in the upstream area, which causes a direction of the flow toward the spray holes.

Figure 3:
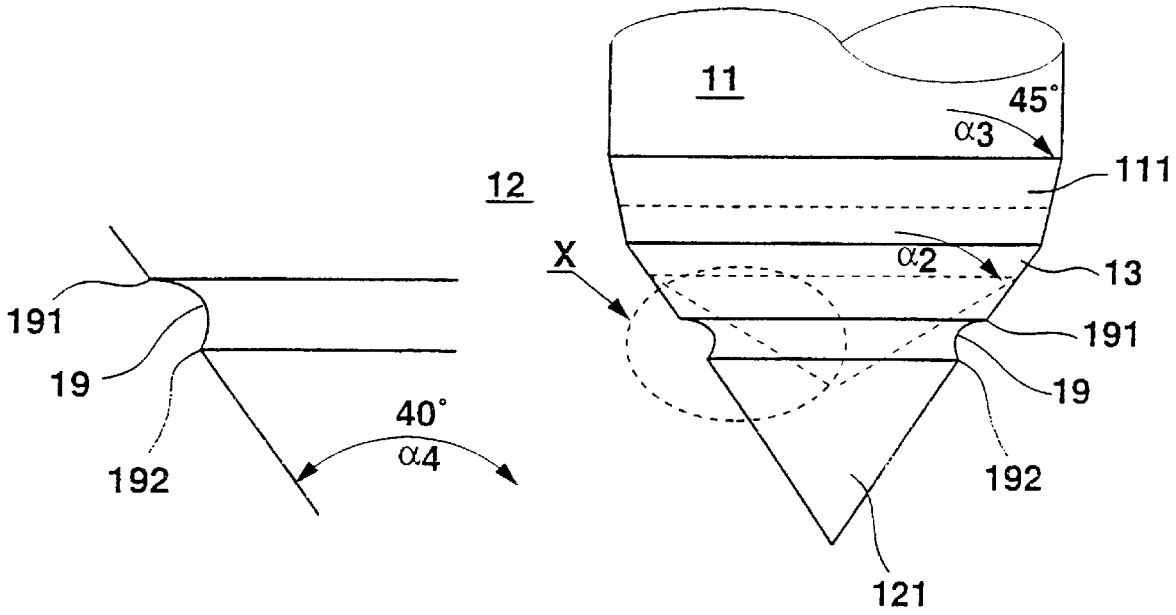
FIG. 3 shows a diagram of the needle tip of the nozzle needle of the first embodiment shown in FIG. 1 with detail X enlarged.

FIG. 3 shows needle tip 12 of nozzle needle 11 from FIG. 1 further enlarged. As can be seen, particularly from the enlarged section X, the concave curve 18 is formed by a radius which in the embodiment shown is 0.5 mm. Because of this radius, a hollow cavity-shaped, ring-shaped recess is formed which runs from a first edge 191 at the sealing surface 13 to a second edge 192 at the front end section 121 of needle tip 12. The concave curve 18 on the inside of the needle housing 14 is also formed by a radius which runs from an upstream edge 181 to a downstream edge 182, see FIG. 1. As can also be seen from FIG. 1, the center of the concave expansion 18 of needle housing 14, with valve closed, is offset upstream compared to the center of the concave expansion 19 of needle tip 12. In this embodiment, the two expansions 18, 19 on needle housing 14 and needle tip 12 are formed with equal radii so that a cavitation space width of approximately 1 mm results at the widest point.

Figure 2:
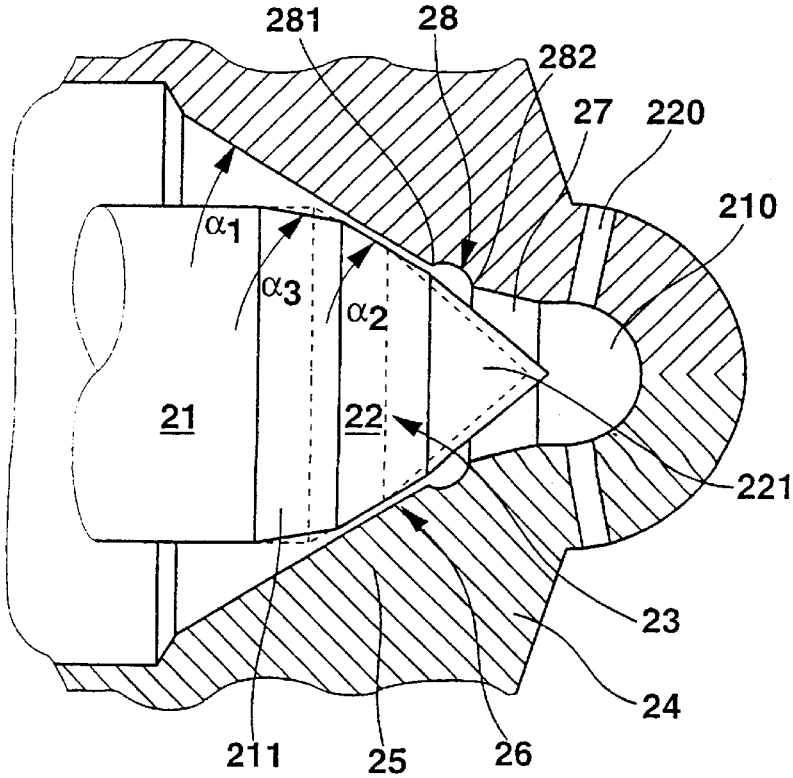
FIG. 2 shows a cut-away side view of a fuel injector in the area of the needle tip according to a second embodiment of the invention.

In a cut-away side view, FIG. 2 shows a second embodiment of a fuel injector for a combustion engine as a component of a common rail injection system that matches the first embodiment shown in FIG. 1 in its major components. In a needle housing 24, a nozzle needle is mounted that can be moved in axial direction, whose needle body is provided with reference number 21. At the needle tip 22 of nozzle needle 21, a sealing surface 23 is formed which cooperates with a sealing surface 26 of a sealing seat 25 formed in needle housing 24 in the sense of an opening and closing of the injector during the movement of the nozzle needle 21. On the front side of the needle tip 22, a pocket hole 210 is formed in the needle housing 24 from which injector openings 220 extend that serve to inject fuel into the combustion chamber of the combustion engine. An end section 221 formed on the front side of needle tip 22 extends into this pocket hole 210. Between sealing surface 23 and needle body 21, a transition surface 211 is formed that has an opening angle $a_3$ and which essentially halves the angle between needle body 21 and sealing surface 23. Downstream of the sealing seat formed by the sealing surfaces 23 and 26, on the inside surface of needle housing 24, an expansion of the ring-shaped flow channel 27 running between needle tip 22 and needle housing 24 is formed in the shape of a conical curve 28. The opening angle $a_2$ of sealing surface 23 on the needle tip 22 is smaller than the opening angle $a_1$ of sealing surface 26 of valve seat 25. In the embodiment shown, the opening angle $a_1$ of sealing surface 26 of valve seat 25 is 60° and opening angle $a_2$ of sealing surface 23 of needle tip 22 is 58.5°. This means that the narrowest point of the needle sealing seat formed by the two sealing surfaces 23, 26 is directly upstream of the concave expansion 28 of needle housing 24, which forms a cavitation space or a "cavitation trap" for cavitation bubbles, which are formed in a defined way at the narrowest point of the needle sealing seat. For comparison with a standard needle tip geometry, one is shown in dotted lines in FIG. 2.

Figure 4:
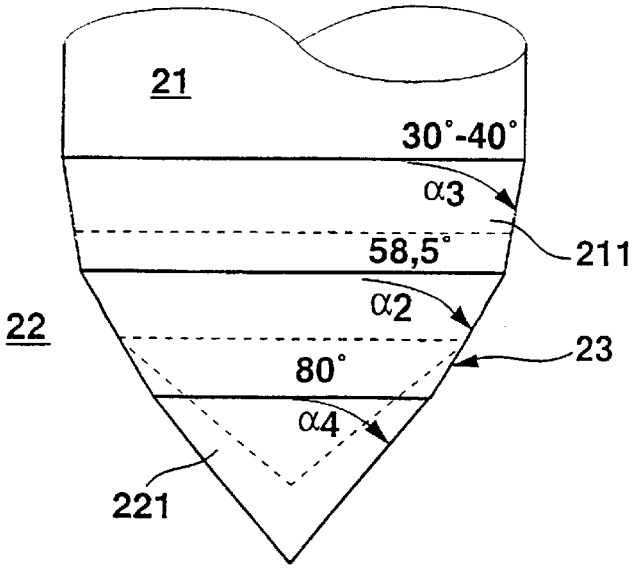
FIG. 4 shows a diagram of the needle tip of the nozzle needle of the second embodiment of FIG. 2 in enlarged scale.

FIG. 4 shows, in enlarged detail, the needle tip 22 of nozzle needle 21 from FIG. 2. As indicated, the opening angle $a_2$ of sealing surface 23 is 58.5° compared to opening angle $a_1$ of 60° of sealing surface 26 of valve seat 25. The transition surface 211 has an opening angle $a_3$ of 30° to 40°, whereby the opening angle $a_2$ essentially halves the sealing surface 23. The opening angle $a_4$ of end section 221 of needle tip 22 is 80° in the embodiment shown.

Figure 5:
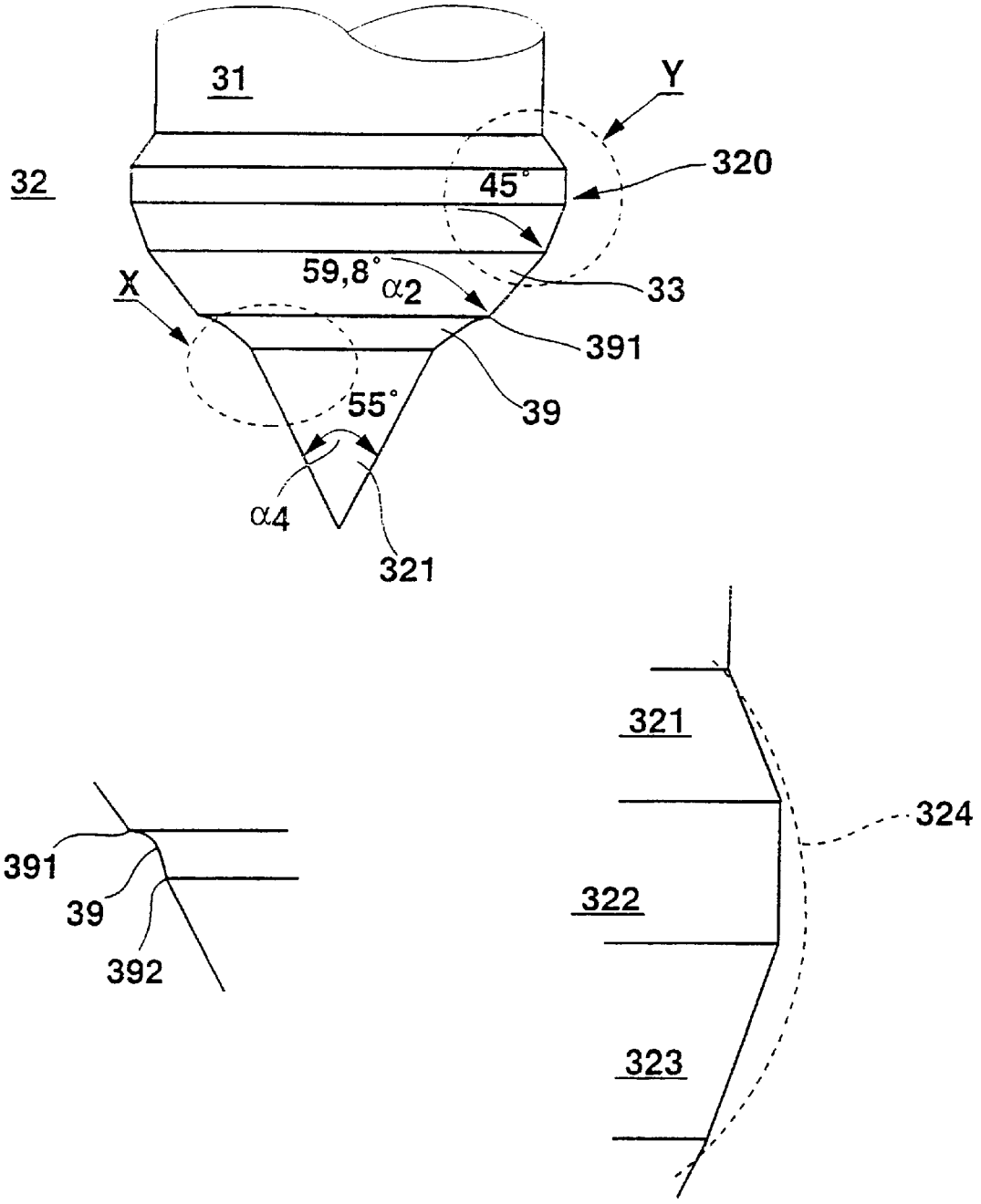
FIG. 5 shows the needle tip of a nozzle needle according to a third embodiment of the invention with details X and Y.

In a third embodiment of a nozzle needle shown in FIG. 5, as can be combined with a needle housing of the type shown in FIG. 1 or FIG. 2, on the needle tip 32 upstream of a sealing surface 33, a bead-shaped section 320 is formed that is wider compared to the diameter of the needle body 31. This bead-shaped section 320 is formed of successive ring surfaces 321, 322, 323 of which the ring surfaces 321 and 323 are formed as conical surfaces while ring surface 322 is formed in the shape of a cylindrical ring surface, see detail Y. The diameter of the bead-shaped section 320, at its widest point, i.e. at the ring surface 322, is around 1.15 times the diameter of needle body 31 of the nozzle needle. The longitudinal expansion of the bead-shaped section 320 in the direction of the needle axis is about 0.25 times the diameter of the needle body 31. As a deviation from the design of the bead-shaped section 320 by successive conical and cylindrical ring surfaces, the bead-shaped surface 320 can also be formed of a lens-shaped or ball-shaped surface 324 as is shown in dotted lines in detail Y.

Following immediately after the sealing surface 33 of needle tip 32, an expansion in the shape of a conical curve 39 is formed, which is formed by a radius as shown in detail X. On one side, the conical expansion 39 gradually changes with one edge 391 into the sealing surface 33 and on the other side with one edge 392 into the end section 321 of the nozzle tip 32.

As shown in FIG. 5, sealing surface 33 of needle tip 32 has an opening angle $a_2$ of 59.8° compared to an opening angle $a_1$ of 60° of the valve seat sealing surface of the combined needle housing. The opening angle $a_4$ of end section 321 is 55°. Conical ring surface 323 of bead-shaped section 320 is designed with an opening angle of 45° as the transition surface between sealing surface 33 and the cylindrical ring surface 322 of bead-shaped section 320.

REFERENCE NUMBER LIST

1;20 Injector nozzle
11;21;31 Nozzle needle, needle body
12;22;32 Needle tip
13;23;33 Sealing surface
14;24 Needle housing
15;25 Valve seat
16;26 Sealing surface
17;27 Flow channel
18;28 Concave curve
19 Concave curve
110;210 Pocket hole
120;220 Injection opening
181;281 Edge
182;282 Edge
191;391 Edge
192;392 Edge
111;211 Transition surface
121;221;321 End section
320 Bead-shaped section
321 Ring surface
322 Ring surface
323 Ring surface
324 Ball-shaped surface

What is claimed is:

1. Fuel injector assembly for a combustion engine, comprising:

a valve seat; and a nozzle needle adapted to be linked with an actuating element and having a needle tip that cooperates with the valve seat to control a nozzle-opening process; wherein:

the valve seat has a conical sealing surface with an opening angle $\alpha_1$;

the needle tip has a conical sealing surface with an opening angle $\alpha_2$;

the conical sealing surface of the needle tip contacts the conical sealing surface of the valve seat when the injector is closed;

the needle tip and the needle housing define a ring-shaped flow channel when the injector is open;

the opening angle $\alpha_2$ of the sealing surface of the needle tip is smaller than the opening angle $\alpha_1$ of the sealing surface of the valve seat;

in a flow direction of fuel, downstream of the sealing surfaces of the needle tip and valve seat housing, an expansion of the ring-shaped flow channel is formed between the needle tip and needle housing; and the expansion forms a cavitation space, in which implosion of the cavitation bubbles occurs away from surfaces of the needle tip and the needle housing that define the ring shaped flow channel.

2. The fuel injector according to claim 1, wherein the expansion of the flow channel is situated immediately following the sealing surfaces of the needle tip and valve seat, in the fuel flow direction.

3. The fuel injector according to claim 1 wherein, the expansion of the flow channel is formed by a concave curved cross section of at least one of the surfaces of the needle tip and needle housing.

4. The fuel injector according to claim 3, wherein an upstream side of the concave curved cross section is formed by a radius.

5. The fuel injector according to claim 3, wherein an upstream side of the concave curved cross section gradually changes at one edge into the sealing surface of the needle tip or the valve seat.

6. The fuel injector according to claim 3, wherein a downstream side of the concave curved cross section gradually changes at one edge into the surface of the needle tip or the needle housing.

7. The fuel injector according to claim 3, wherein, on the surface of the needle tip and needle housing, the expansion of the flow channel with the concave curved cross section is provided and, when the valve is closed, an axial center of the expansion of the needle housing is offset upstream, compared to the center of the expansion of the needle tip.

8. The fuel injector according to claim 4, wherein the expansions on the needle housing and needle tip are formed by equal radii.

9. The fuel injector according to claim 1, wherein the opening angle $\alpha_1$ of the valve seat is between 50° and 70°.

10. The fuel injector according to claim 9, wherein the opening angle $\alpha_1$ of the valve seat is approximately 60°.

11. The fuel injector according to claim 9, wherein the opening angle $\alpha_2$ of the sealing surface of the needle tip is between 0.5° to 3° smaller than the opening angle $\alpha_1$ of the valve seat.

12. The fuel injector according to claim 11, wherein the opening angle $\alpha_2$ of the sealing surface of the needle tip is 1.5° smaller than the opening angle $\alpha_1$ of the valve seat.

13. The fuel injector according to claim 1, wherein on the needle tip, upstream of the sealing surface, a transition surface is formed having an angle $\alpha_3$ that is between the needle body and the sealing surface of the nozzle needle.

14. The fuel injector according to claim 13, wherein the transition surface is formed by a conical surface.

15. The fuel injector according to claim 14, wherein the transition surface approximately halves the angle between the sealing surface of the nozzle needle and the needle body.

16. The fuel injector according to claim 1, wherein the needle tip has an end section that comes to a point.

17. The fuel injector according to claim 16, wherein the end section that comes to a point is formed by a cone.

18. The fuel injector according to claim 17, wherein the cone forming the end section that comes to a point has an opening angle $\alpha_4$ that is smaller than the opening angle $\alpha_2$ of the sealing surface of the needle tip.

19. The fuel injector according to claim 18, wherein the opening angle $\alpha_4$ of the end section is advantageously between 40° and 65°, preferably between 50° and 55°.

20. The fuel injector according to claim 1, wherein the needle tip, upstream of the sealing surface, has a bead-shaped section that is enlarged compared to the diameter of the needle body.

21. The fuel injector according to claim 20, wherein the bead-shaped section can be formed of successive conical or cylindrical ring surfaces.

22. The fuel injector according to claim 20, wherein the bead-shaped section can be formed of a lens-shaped or ball-shaped surface.

23. The fuel injector according to claim 20 wherein the diameter of the bead-shaped section is 1.05 times to 1.2 times the diameter of the needle body of the nozzle needle.

24. The fuel injector according to claim 20, wherein the longitudinal expansion of the bead-shaped section in the direction of the needle axis is 0.2 times to 0.6 times the diameter of the needle body of the nozzle needle.

25. The fuel injector according to claim 1, wherein the opening angle $\alpha_1$ of the valve seat is between 55° and 65°.

26. The fuel injector according to claim 9, wherein the opening angle $\alpha_2$ of the sealing surface of needle tip is between 1° and 2° smaller than the opening angle $\alpha_1$ of the valve seat.

27. The fuel injector according to claim 24, wherein the longitudinal expansion of the bead-shaped section in the direction of the needle axis is 0.25 times to 0.35 times the diameter of the needle body of the nozzle needle.

28. The fuel injector according to claim 23, wherein the diameter of the bead-shaped section is 1.1 times to 1.15 times the diameter of the needle body.

29. Fuel injector assembly for a combustion engine, comprising:

a valve seat; and a nozzle needle adapted to be linked with an actuating element and having a needle tip that cooperates with the valve seat to control a nozzle-opening process; wherein:

the valve seat has a conical sealing surface with an opening angle $\alpha_1$;

the needle tip has a conical sealing surface with an opening angle $\alpha_2$;

the conical sealing surface of the needle tip contacts the conical sealing surface of the valve seat when the injector is closed;

the needle tip and the needle housing define a ring-shaped flow channel when the injector is open;

the opening angle $\alpha_2$ of the sealing surface of the needle tip is smaller than the opening angle $\alpha_1$ of the sealing surface of the valve seat;

in a flow direction of fuel, downstream of the sealing surfaces of the needle tip and valve seat housing, an expansion of the ring-shaped flow channel is formed between the needle tip and needle housing;

the expansion forms a cavitation space, in which implosion of the cavitation bubbles occurs away from surfaces of the needle tip and the needle housing that define the ring shaped flow channel; and the expansion of the flow channel is formed by a curved cross-section of at least one of the needle tip and needle housing, downstream of the expansion.

30. The fuel injector according to claim 29, wherein a segment of the needle housing downstream of the valve seat is designed as a cone surface with an opening angle measured according to the longitudinal axis of the fuel injector, that is smaller than the opening angle $\alpha_1$ of the sealing surface located upstream.

31. A fuel injector device for a combustion engine comprising:

a preliminary reservoir for holding a fuel under high pressure; and a fuel injector including a nozzle needle body and a needle tip linked to an actuating element that controls a nozzle-opening formed by the needle tip and a valve seat of a needle housing, the fuel injector continuously being stressed by the fuel held in the preliminary reservoir;

wherein the valve seat of the needle housing includes a conical sealing surface having an opening angle $\alpha_1$;

wherein the needle tip includes a conical sealing surface having an opening angle $\alpha_2$ which contacts the valve seat when the fuel injector is in a closed position, and the needle tip and the needle housing form a ring-shaped flow channel when the fuel injector is open;

wherein the opening angle $\alpha_2$ of the conical sealing surface of the needle tip is smaller than the opening angle $\alpha_1$ of the conical sealing surface of the valve seat; and wherein downstream of the sealing surface of the needle tip and the valve seat, in a fuel flow direction, an expansion of the ring-shaped flow channel is formed between the needle tip and the needle housing which provides a cavitation space for the implosion of cavitation bubbles at a distance away from surfaces of the needle tip and the needle housing, which define the annular flow channel.

* * * * *